United States Patent [19]

Raupach

[11] Patent Number: 4,586,449

[45] Date of Patent: May 6, 1986

[54] THREAD CUTTING DEVICES FOR DOUBLE LOCKSTITCH SEWING MACHINES

[75] Inventor: Günter Raupach, Bielefeld, Fed. Rep. of Germany

[73] Assignee: Kochs Adler AG, Fed. Rep. of Germany

[21] Appl. No.: 570,865

[22] Filed: Jan. 16, 1984

[30] Foreign Application Priority Data

Jan. 29, 1983 [DE] Fed. Rep. of Germany ..... 3303032

[51] Int. Cl.[4] ..... D05B 65/00

[52] U.S. Cl. ..... 112/292; 112/294; 112/297; 112/300

[58] Field of Search ..... 112/291, 292, 294, 297, 112/298, 300

[56] References Cited

U.S. PATENT DOCUMENTS

| | | | |
|---|---|---|---|
| 3,503,355 | 3/1970 | Hagemeyer et al. | 112/292 |
| 3,624,735 | 11/1971 | Hedegaard | 112/292 |
| 3,894,499 | 7/1975 | Hamlett | 112/184 X |
| 4,141,307 | 2/1979 | Okada | 112/292 |

*Primary Examiner*—Wm. Carter Reynolds

*Attorney, Agent, or Firm*—Laff, Whitesel, Conte & Saret

[57] ABSTRACT

A thread cutting device for a double lockstitch sewing machine is provided with a rotatably driven hook including a hook beak for seizing a needle thread loop. In order to assure a safe pickup, the thread catcher performs an operating movement in a tilt direction oppositely directed with respect to the direction of rotation of the hook. Furthermore, the thread catcher is operable if the hook point has passed the stitch hole for a range of about 90° considered in the direction of rotation of the hook.

6 Claims, 12 Drawing Figures

Fig. 1
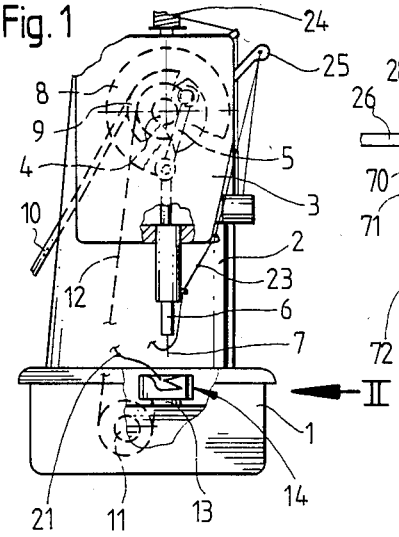
Fig. 2
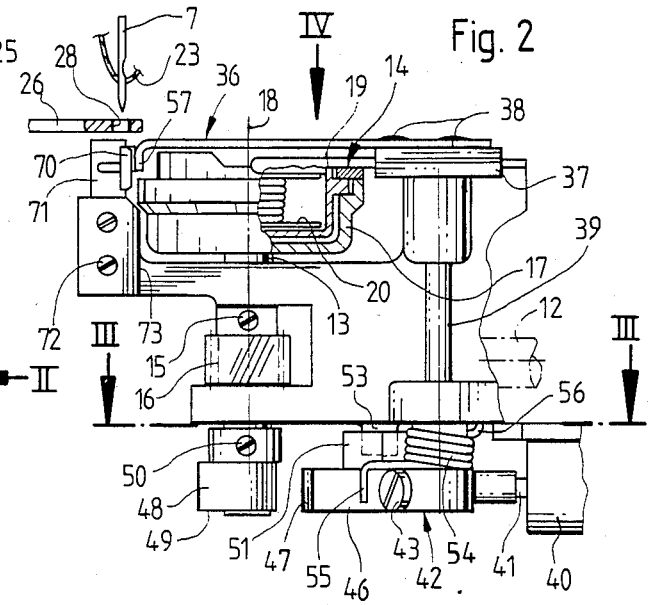
Fig. 3
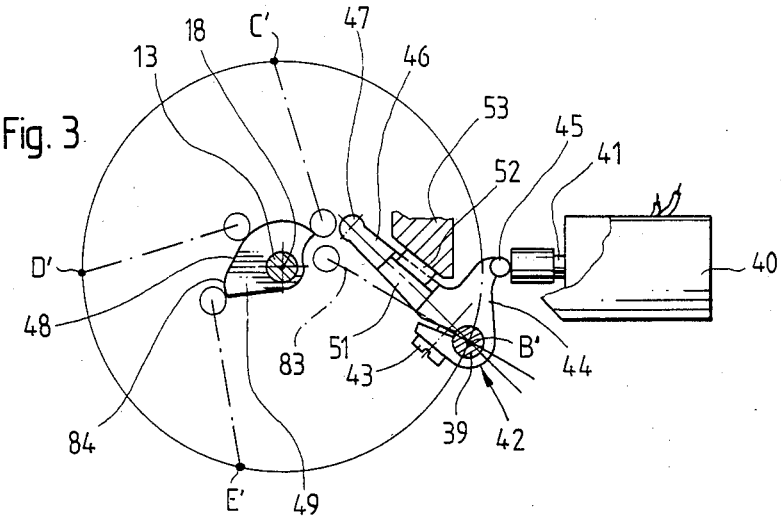
Fig. 7
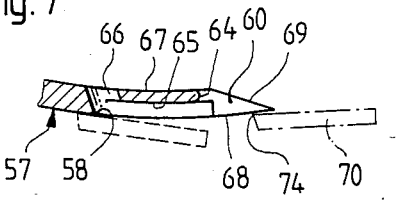
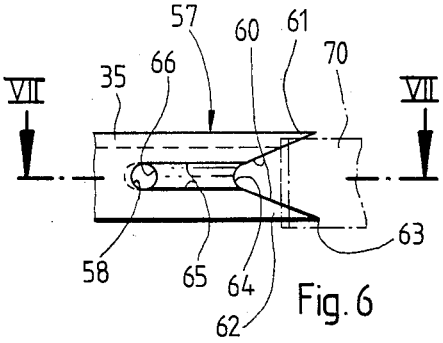
Fig. 6

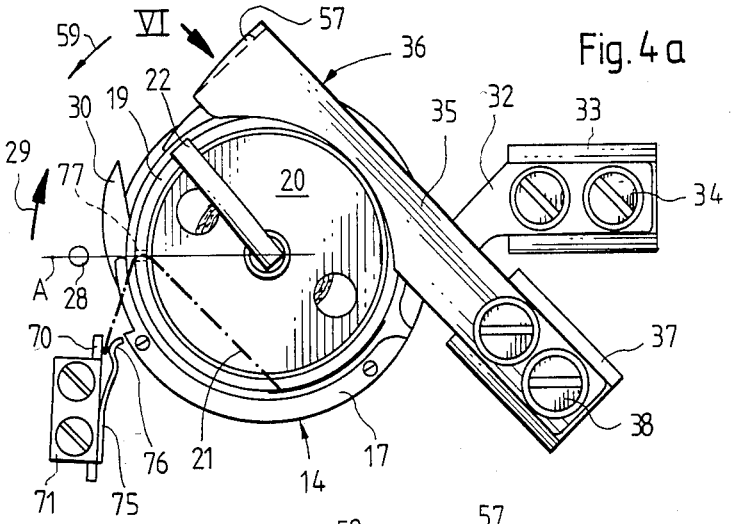
Fig. 4 a
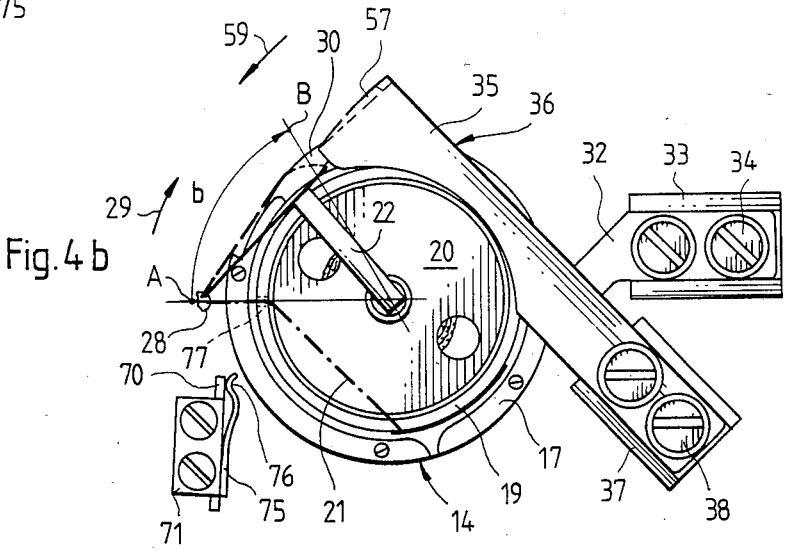
Fig. 4 b
Fig. 4 c
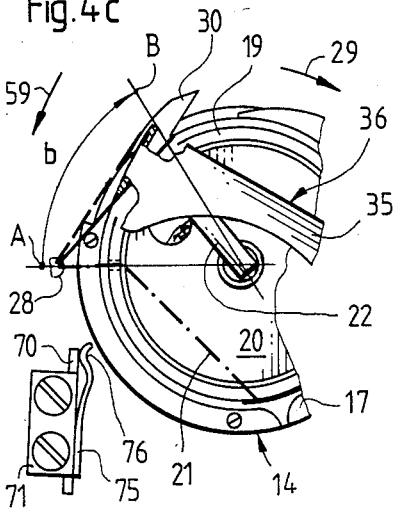
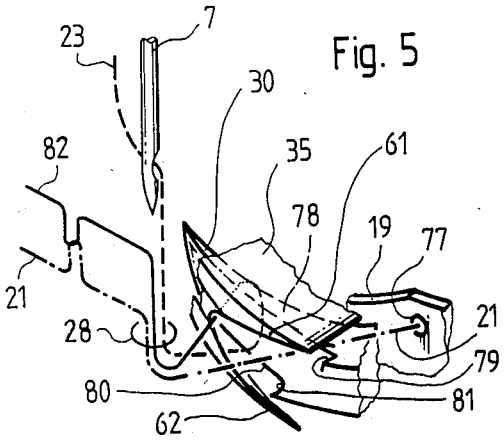
Fig. 5

Fig. 4d
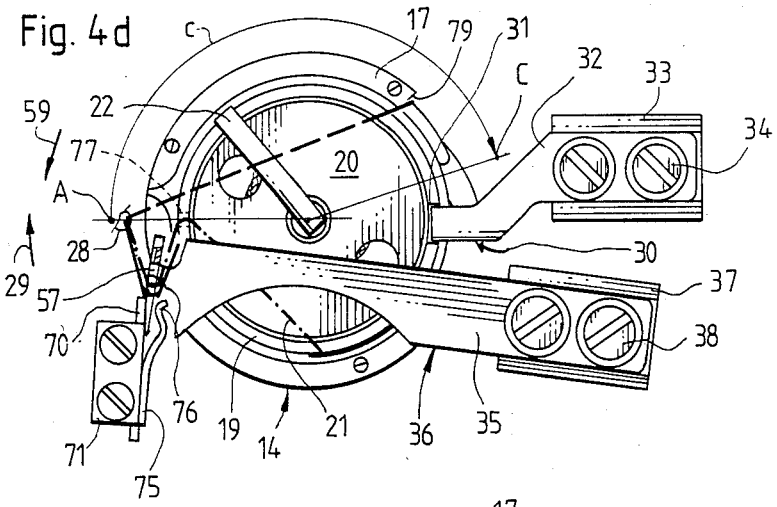
Fig. 4e
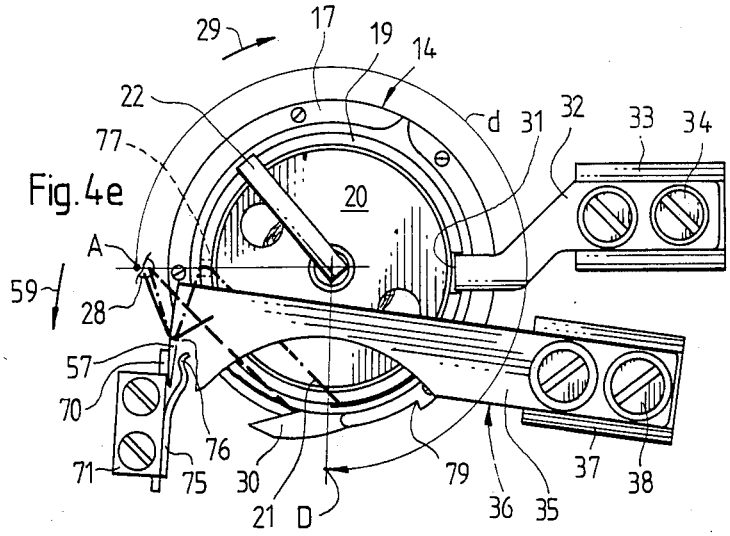
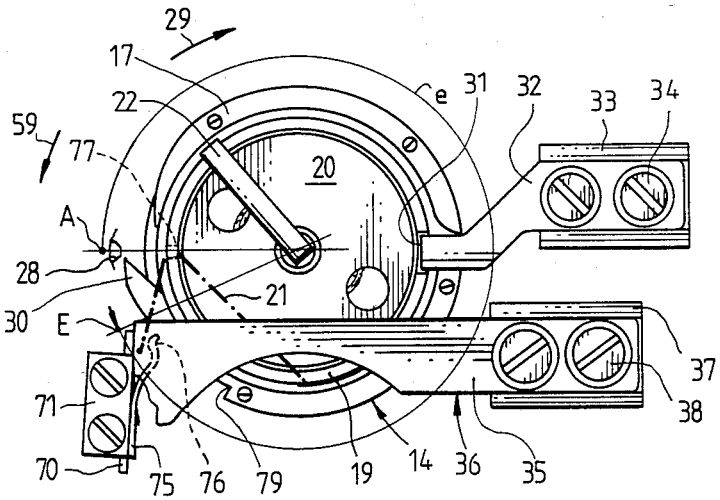
Fig. 4f

THREAD CUTTING DEVICES FOR DOUBLE LOCKSTITCH SEWING MACHINES

BACKGROUND OF THE INVENTION

This invention relates to a thread cutting device for a double lockstitch sewing machine provided with a hook rotatably driven about an axis parallel to the needle. In particular, the invention relates to a thread cutting device provided with a knife arm tiltably arranged about an axis parallel to the hook axis and provided with a thread catcher including a cutting edge, at which the thread catcher is formed with a leg directed towards the thread catching direction so as to catch particular threads during the thread cutting operation.

A thread cutting device of this type is known from U.S. Pat. No. 3,624,735 in which the thread catching arm is formed with a cutout so as to catch the bobbin thread leaving the bobbin case at an outlet opening. In operation, the thread catcher of the thread cutting device is tilted in the rotating direction of the hook point when the needle thread loop has been pulled out completely around the bobbin case and especially at an instant when already the needle thread point leading towards the workpiece to be sewn is positioned in a lower area and when the portion of the needle thread leading towards the needle is positioned in the upper region. In order to catch the portion of the needle thread leading towards the workpiece the upper leg of the thread catcher having a leading point limits the corresponding cutout towards the upper direction. Furthermore, this leg has an upwardly overbent profile so that the upper positioned part of the needle thread leading towards the needle will be deflected upwardly thus not caught by the thread catcher. The catching of the threads is carried out at an instant when the needle thread surrounding the bobbin case starts to fall off. In this instant the threads to be caught by the thread catcher are relatively loose. At this known thread cutting device a specially profiled finger preventing a rotation of the bobbin case together with a hook body must be arranged at the bobbin case at the area of the stitch hole of the throat plate as to render possible the movements of the thread catcher.

SUMMARY OF THE INVENTION

It is a primary object of the invention to provide a thread cutting device of the aforesaid type having a simple construction of the thread catcher as to assure a safe pickup of the threads to be cut.

It is a further object of this invention to provide a thread cutting device having a thread catcher performing a thread catching moving by a tilt operation oppositely directed to the direction of rotation of the hook as to pickup the threads being exposed to a stress.

It is still another object of this invention to create a thread cutting device, at which the operation of the thread catcher is timed in such a way that the portions of the needle thread and the bobbin thread leading towards the stitch hole are about equally positioned to each other and in slightly rising area towards the stitch hole as the portion of the needle thread leading towards the needle is positioned below the hook beak.

Still a further object of the present invention is to provide a thread cutting device which is inexpensive to manufacture and reliable in operation.

Still a further object of the present invention is to provide a thread cutting device which renders possible to sever the needle thread and the bobbin thread forming a double lockstitch closely at the underside of the workpiece and also to assure a safe restart of stitching, i.e. a positive grip of the off-cut end of the bobbin thread.

The above listed objects are achieved in a simple manner by providing an operating movement of the thread catcher wherein the latter performs a tilt motion oppositely directed with respect to the direction of rotation of the hook. Due to this motion the threads to be cut can be picked up in a phase in which the threads are properly positioned and also are exposed to stress. Hereby a positive pickup of the threads is achieved by simply constructed elements which are reliable in operation. Due to the particular tilt motion of the thread catcher it is assured that the threads to be cut are safely guided until the actual cutting procedure is carried out. With the arrangement of the bobbin case retaining finger in an about diametral position with respect to the stitch hole essential space is cleared rendering possible the reduction of friction imposed to the threads during the stitch formation as well as assuring enough freedom for the thread catcher to operate.

BRIEF DESCRIPTION OF THE DRAWINGS

The invention will now be further described, by way of example, with reference to the drawings, in which :-

FIG. 1 is a schematic front view of one embodiment of a sewing machine according to the invention;

FIG. 2 is a partially broken away view of the area of a double lockstitch hook as viewed in the direction of the arrow II in FIG. 1;

FIG. 3 is a view of the area driving a thread cutting device taken along line III—III in FIG. 2;

FIGS. 4*a* to 4*f* are top plan views of the area of the double lockstitch hook and the thread cutting device according to the arrow IV in FIG. 2 showing different operating positions of the hook and the thread cutting device;

FIG. 5 is a schematic perspective view of the threads to be seized by the thread cutting device;

FIG. 6 shows the thread catcher of the thread cutting device taken in the direction of the arrow VI in FIG. 4*a*; and FIG. 7 is a section through the thread catcher taken along line VII—VII in FIG. 6.

DESCRIPTION OF THE PREFERRED EMBODIMENT

FIG. 1 refers to a sewing machine having a base plate 1 with an upstanding standard 2 and an arm 3 extending from the latter and parallel to the base plate 1. In the arm 3 there is pivoted an arm shaft 4, which drives via a crank gear 5 a needle bar 6 carrying a needle 7. At the end turned to the standard 2, the arm shaft 4 receives a handwheel 8 with a belt pulley 9 connected via a belt 10 to a motor (not shown) for driving the sewing machine.

In the base plate 1 there is pivoted a hook driving shaft 11 synchronously driven by the arm shaft 4 via a timing belt drive 12. The horizontally extending hook driving shaft 11 drives a vertically arranged hook shaft 13 of a double lockstitch hook 14 via a gear 16 fastened by means of a setscrew 15 to the hook shaft 13.

To the upper end of the hook shaft 13 there is secured a hook body 17 of the hook 14. The hook body 17 is commonly formed like a cup for pivotally receiving a bobbin case 19 concentrically arranged with respect to an axis of rotation 18 of the hook 14. The bobbin case 19 receives a bobbin 20 extending concentrically with respect to the axis of rotation 18. The bobbin 20 carries a supply of bobbin thread 21 and is secured in the bobbin case 19 by means of a tiltable latch 22.

The needle 7 carries a needle thread 23 supplied from a spool 24 via a thread take-up lever 25, which is driven in usual manner by the arm shaft 4. The spool 24 is arranged on the arm 3.

At the upper surface of the base plate 1 there is arranged a throat plate 26 having a stitch hole 28 through which passes the descending needle 7 with the needle thread 23. At its outer circumference the hook body 17 is formed with a tapered hook beak 30, extending in the direction of rotation 29 and terminating in a hook point (not denoted). When passing the needle 7 having entered the stitch hole 28, the hook beak 30 seizes the needle thread 23 formed as a loop and carries it, about the bobbin case 19 for forming an interlocking together with the bobbin thread 21.

In so far as described above, the sewing machine with a double lockstitch hook is known.

At its upper margin diametrally opposite to the stitch hole 28 the bobbin case 19 is formed with a recess 31, into which engages the free end of a retaining finger 32. The retaining finger 32 is vertically and radially arranged with respect to the axis of rotation 18 and adjustably secured to a shoulder 33 in the base plate 1 by means of screws 34. Between the retaining finger 32 and the recess 31 there is as much clearance as the needle thread 23 can pass. Moreover, the retaining finger 32 is flush with the upper surface of the hook 14, so that there is free space above the hook 14 and especially in the area of the stitch hole 28. The space above the hook 14 may be occupied by a knife arm 35 of a thread cutting device 36. The knife arm 35 is secured to a knife carrier 37 by means of screws 38, while the knife carrier in turn is fastened to a shaft 39 supported in the base plate 1. The drive of the shaft 39 and thus the drive of the thread cutting device 36 is carried out by a solenoid 40 fastened to the base plate 1 and having a push rod 41.

Nearly in the plane of the push rod 41 of the solenoid 40 an angle lever 42 is connected to the shaft 39 by means of a clamping screw 43. The shorter lever arm 44 of the angle lever 42 rests cooperatingly with a rounded end 45 against the push rod 41. The longer lever arm 46 of the angle lever 42 is also formed with a rounded end 47 cooperating with a guiding surface 48 of a cam disk 49. The cam disk 49 is connected to the lower end of the hook shaft 13 by means of a setscrew 50.

At the longer lever arm 46 of the angle lever 42 there is formed a projection 51 abutting against a shock absorber 52 located at a shoulder 53 of the base plate 1. The shock absorber 52 for instance is made from rubber and reduces the impact of the angle lever 42 when returning into its inoperative position as shown in FIG. 3.

At the angle lever 42 there is provided a prestressed torsion spring 54, one end 55 of which rests against the angle lever 42, while the other end 56 is fixed to the base plate 1. The deflection of the angle lever 42 causing the rounded end 47 of the lever arm 46 to rest against the guiding surface 48, is effected against the force of the torsion spring 54. After getting free of the guiding surface 48, the spring 54 returns the angle lever 42 into its inoperative position.

At its free end opposite to the knife carrier 37, the knife arm 35 has a bent part forming a thread catcher 57, which is provided with a cutting edge 58. For seizing the needle thread 23 and the bobbin thread 21 as described hereinafter, the thread catcher 57 is formed at its leading edge with respect to its tilt direction 59, i.e. opposite to the direction of rotation 29, with a V-shaped cutout 60, which is limited by an upper leg 61 and a lower leg 62. The latter terminates in a point 63. The bottom of the V-shaped cutout 60 is formed by a rounded section 64, from which extends up to the cutting edge 58 and opposite to the swivel direction 59 a slot-shaped recess 65. The cutting edge 58 of the thread catcher 57 is formed by an inclined bore 66. The inner surface 67 of the thread catcher 57 turned towards the shaft 39 is provided with a wedge-shaped section, 69 which extends in swivel direction 59 taperingly towards the outer surface 68.

To the thread catcher 57 there is associated a stationary counter knife 70 secured to a knife holder 71. The knife holder 71 is fixed by means of screws 72 to a shoulder 73 situated in the base plate 1. The counterknife 70 has a cutting edge 74, which, as the knife arm 35 together with the thread catcher 57 are tilted accordingly, contacts the outer surface 68 of the thread catcher 57 and in particular cooperates with the cutting edge 58 of the latter.

At the counterknife 70 there is provided a thread clamp 75, which is formed in the area of the cutting edge 74 with a semicircularly bent front end 76. As the thread catcher 57 is formed in the area of its leading end with the wedge-shaped section 69 located at the inner surface 67, the thread catcher 57 with its outer surface 68 resting against the cutting edge 74 of the counterknife 70 can move between the counterknife 70 and the thread clamp 75, at which then the rounded front end 76 of the thread clamp 75 rests against the inner surface 67 of the thread catcher 57.

Adjacent to the region of the stitch hole 28 the bobbin thread 21 leaves the bobbin case 19 through an outlet 77 located in the area of the upper margin of the bobbin case 19. From here the bobbin thread 21 extends directly to the stitch hole 28 as illustrated by a dot-dash-line in FIG. 5.

At the transition from the upper surface 78 of the hook beak 30 to the hook body 17 there is located a recess 79 through which the needle thread 23 after being seized by the hook beak 30 moving in the direction of rotation 29 is drawn upon the upper surface of the bobbin 20. At the transition from the lower surface 80 of the hook beak 30 to the hook body 17 there is formed a rounding 81, in which the needle thread 23 is guided.

Operation is described as follows:

In FIG. 5 there is shown a seam, which should be produced in a workpiece (not shown). The seam is formed by a bobbin thread 21 illustrated by a dot-dashed line and located at the bottom of the seam, and an upper thread 82 illustrated by a completely drawn line and located at the top of the seam, wherein both threads 21, 82 are interlocked to each other.

For the purpose of a clear description the upper thread 82 is defined as originating at the upper side 78 of the hook beak 30. Accordingly the initial portion of the upper thread 82 is illustrated by dots, whereas the needle thread 23 is illustrated by a dashed line. Furthermore, the remaining portion of the upper thread 82 after the thread cutting operation will be denoted as the upper thread tail extending from the stitch hole 28 to the rounded section 64 of the thread catcher 57 as shown in FIG. 5 by a completely drawn line.

For producing the seam according to FIG. 5, the needle 7, after penetrating the not illustrated workpiece and reaching the lower dead center position, rises for a determined distance defined as loop stroke, at which the needle thread 23 carried by the eye of the needle 7 forms a loop. In this loop the upper section (in FIG. 5 drawn in full line) still belonging to the upper thread 82 of the seam is positioned at the top, while the section of the needle thread 23 (dash-lined) leading to the needle 7 is positioned at the bottom. At this instant, this loop is seized by the point of the hook beak 30 drawn around the bobbin 20 including the bobbin thread 21 thus forming the illustrated seam. Then, the loop is cast off by the hook 14, at which the excessive needle thread 23 is pulled upwardly by the thread take-up lever 25. In general this method of producing a seam is known.

Thread cutting is performed as follows:

Immediately after the hook beak 30 enters the loop as illustrated in FIG. 5, the needle thread 23 together with the upper thread 82 forms a triangle. The upper thread 82 forms the leg extending from the stitch hole 28 to the upper surface 78 of the hook beak 30, whereas the dash-lined needle thread 23 forms the vertical leg extending from the upper surface 78 to the lower surface 80 of the hook beak 30 and the leg extending from the lower surface 80 of the hook beak 30 to the stitch hole 28. The bobbin thread 21 extends somewhat above the upper surface of the triangle from the outlet 77 of the bobbin case 19 to the stitch hole 28.

The point 63 of the lower leg 62 of the thread catcher 57 moves during a tilt movement of the knife arm 35 according to the swivel direction 59 in a horizontal plane located between the upper surface 78 and the lower surface 80 of the hook beak 30, however, in any case above the rounding 81. The V-shaped cut-out 60 extends from the point 63 upwardly, however, in any case up to above the outlet 77. Thus, when the thread catcher 57 moves oppositely with respect to the direction of rotation 29 of the hook beak 30, the V-shaped cutout 60 seizes the bobbin thread 21 and the upper thread 82, i.e. the section of the needle thread 23 turned to the seam of the workpiece, while the section of the needle thread 23 located about the lower surface 80 of the hook beak 30 and returning to the needle 7 is not seized by the thread catcher 57.

In FIG. 4*a* the thread cutting device 36 is shown in its basic position, while the sewing operation is carried out. Furthermore, in FIG. 4*a* the double lockstitch hook 14 is shown in a position in which the loop of the needle thread 23 is picked up by the hook beak 30 and drawn out in a shape according to the described triangle, the vertical basis of which is determined by the recess 79 and the rounding 81. The earliest instant the thread cutting device 36 could be actuated, is represented by such a position, in which the rounding 81 and the recess 79 are positioned on a connecting line placed between the stitch hole 28 and the axis of rotation 18. According to FIG. 4*a* the position of the rotating hook beak 30 is denoted with "A". In order to achieve a positive action, the thread cutting device 36 will be actuated a little bit later as the hook beak 30 has moved through an angle "b" in the direction of rotation 29, which is illustrated in FIG. 4*b*. As shown in this figure, the hook body 17 and the hook beak 30 respectively have moved through the angle "b" of about 20° to 60°, at which the position of the hook beak 30 is now denoted as position "B". The angle "b" can be in a range up to 90°. In this angular position "B" of the hook beak 30 the solenoid 40 will be energized by an impulse so as to initiate the tilt movement of the knife arm 35 of the thread catcher 57 according to the direction of rotation 29 and oppositely directed with respect to the swivel direction 59 for catching the upper thread 82 and the bobbin thread 21. The instant for catching both threads 82, 21 by the thread catcher 57 is illustrated in FIG. 4*c*. Subsequently, the tilt movement of the knife arm 35 will be continued until the position shown in FIG. 4*d* has been reached. In this position of the knife arm 35 of the thread catcher 57, the V-shaped cutout 60 already is closed by the counterknife 70, thus guiding the upper thread 82 and the bobbin thread 21 in the rounded section 64 of the thread catcher 57. Furthermore, the rounded front end 76 of the thread clamp 75 has contacted the inner surface 67 of the thread catcher 57 by running up the wedge-shaped section 69 at the tilt movement of the knife arm 35. In this position the thread catcher 57 remains stationary, i.e. both ends of the threads leading towards the not illustrated workpiece are exactly guided. Subsequently, the hook body 17 continues to rotate until an angle "c" of about 160° to 170° has been completed, at which the needle thread 23 has been pulled over the bobbin case 19 due to the action of the recess 79. As the position "C" has been reached, the drawn out needle thread 23 will be pulled through the recess 31 and under the retaining finger 32. As soon as the hook body 17 including the hook beak 30 has continued to move and reached the position "D", which is positioned with respect to the position "A" about an angle "d"=270°, then the knife arm 35 of the thread catcher 57 will be tilted further. The beginning of this tilt movement is illustrated in FIG. 4*e* and its termination is shown in FIG. 4*f*, at which the hook body 17 including the hook beak 30 has been rotated for an angle "e" of about 340°, so that the position "E" is reached. Due to the coaction of the cutting edges 74 and 58, the lower thread 21 and the upper thread 82, i.e. the portion of the needle thread 23 leading toward the workpiece (not illustrated), have been cut. Subsequently, the knife arm 35 of the thread catcher 57 will be tilted back into the basic position as shown in FIG. 4*a*. The end of the lower thread 21 leading towards the bobbin case 19, and the end of the needle thread 23 remain clamped between the front end 76 of the thread clamp 75 and the counterknife 70 as the thread ends leading towards the workpiece (not shown) are free. Now, both threads are positioned properly in order to start a new seam. On removing the workpiece, the end of the needle thread 23 clamped by the thread clamp 75, will be drawn away so that only the lower thread 21 remains in the clamped position. Due to this procedure, the needle thread 23 is long enough to assure a safe initiating of stitching. Since the counterknife 70 is positioned backwardly with respect to the outlet 77 and regarded with respect to the direction of rotation 29, also the bobbin thread 21 is ideally positioned for initiating stitching.

The described movements of the thread cutting device 36 are as follows:

By energizing the solenoid 40 the push rod 41 will be extended so that by abutting against the round end 45 of the short lever arm 44 the angle lever 42 will be displaced from its basic position into an operative position schematised only by a dash-dotted-line as shown in FIG. 3. Energizing of the solenoid 40 is performed at an instant as the hook body 17 including the hook beak 30 is in the position "B". At this, the rounded end 47 of the long lever arm 46 gets into contact with the guiding surface 48 of the cam disk 49, which from now on effects the tilt movements of the knife arm 35 of the thread catcher 57, wherein the steady contact of the rounded end 47 of the long lever arm 46 with the guiding surface 48 is assured without a continued energizing of the solenoid 40.

As will be evident from the foregoing, after the actuation of the thread cutting device 36 by energizing the solenoid 40, the cam disk 49 controls the movement of the knife arm 35.

For the purpose of explanation it may be mentioned that in FIG. 3 the operative positions 83 of the long lever arm 46 are illustrated in relation to the cam disk 49 in such a way as stationary considering the cam disk 49 being surrounded by a running around long lever arm 46. Such kind of illustration is common practice in the science of kinetics. For this reason the relative positions of the longer lever arm 46 with respect to the cam disk 49 are denoted with B', C', D' and E' which correspond to the positions B to E of the hook body 17. The energizing for a short time of the solenoid 40 takes place about in the point B, corresponding to B' in FIG. 3. At this, the rounded end 47 of the long lever arm 46 is brought only into the effective region of the guiding surface 48, however without already contacting the latter at this instant. At further rotation of the hook body 17 and therewith the cam disk 49, then the guiding surface 48 will come into action with the front end 47 of the lever arm 46 about at the point C'. From here then the knife arm 35 carrying the thread catcher 57 will be positively controlled. The knife arm 35 must be kept only in this position by the force of the solenoid 40 until the point C' has been reached. In this position, in which the V-shaped cutout 60 is closed by the counterknife 70, the thread catcher 57 will be kept, at which this position represents almost the same position as illustrated by E resp. E'. The thread cutting operation performed between positions of the hook body 17 relating to points D and E of FIGS. 4*e* and 4*f* and the corresponding points D' and E' of FIG. 3 is effected such that the cam disk 49 is provided with a lobe 84 causing a corresponding tilt movement of the longer lever arm 46 and therewith the thread catcher 57. After passing the lobe 84 the angle lever 42 tilts back into its basic position as shown in FIG. 4*a* due to the torsion spring 54 for reversing the tilt movement. The back tilt movement will be damped by the shock absorber 52.

The invention is not restricted to the above-described embodiment but variations and modifications are possible without departing from the scope of the invention as defined by the appended claims.

For example, in the illustrated and described embodiment a double lockstitch hook 14 was employed, the hook body 17 of which rotates with a double RPM—rate with respect to the movement of the needle 7 and the bobbin case of which is kept by a retaining finger 32 diametrally positioned to the stitch hole 28 of the throat plate 26. It is also possible to employ a hook, the bobbin case of which is secured against rotation in the region of the stitch hole, at which the retaining finger would be profiled so as to render possible a catching of the threads leading towards the workpiece, i.e. the upper thread and the lower thread, after the pick-up of the loop by the hook point of the hook body.

Furthermore, it is possible to provide the described thread cutting device 36 with a thread tension release device that can be operated by the motor driving the sewing machine by the belt 10 at its control box at a suited instant. Thus, the pulling of thread of the thread catcher 57 can be facilitated and also the threads to be cut could be exposed to a counterforce at the instant of the actual thread cutting.

What is claimed is:

1. A thread cutting device for a double lockstitch sewing machine with a needle adapted to pass into a stitch hole, with a rotatably driven hook with a hook beak for catching a needle thread loop, with a rotation axis parallel to the needle and with a bobbin case mounted in the hook in a non-rotary manner with respect to the sewing machine and from which a bobbin thread is fed to the stitch hole and with a thread catcher with a cutting edge which can be moved between the hook and the stitch hole and which cooperates with a substantially fixed counterknife, the thread catcher being movable from a basic position of rest towards said counterknife and having a cutout for catching the bobbin thread and the workpieceside portion of the needle thread and a leg with a point advancing in a direction of movement when catching said threads and which can be moved between the needle-side portion of the needle thread on the one hand and its workpiece-side portion and the bobbin thread on the other hand, in which said direction of movement of the thread catcher when catching said threads is opposite to the direction of rotation of said hook and in which said thread catcher is operable from its basic position of rest towards the counterknife when the hook beak is in a range of up to 90° from the stitch hole in the direction of rotation of said hook.

2. A thread cutting device as claimed in claim 1, in which the said range extends over 20° to 60° from the stitch hole.

3. A thread cutting device as claimed in claim 1, in which the leg of the thread catcher with the advancing point bounds said cutout towards the bottom of said thread catcher.

4. A thread cutting device as claimed in claim 3, in which the point of said leg is positioned above the bottom of the hook beak.

5. A thread cutting device as claimed in claim 1, in which said thread catcher is arranged to be stopped in an intermediate position after catching the threads in which the cutout is already closed by the counterknife.

6. A thread cutting device as claimed in claim 1, in which a retaining finger is provided for holding the bobbin case in a non-rotary manner, said retaining finger being arranged approximately diametrically to the stitch hole and to engage with a clearance in a recess on the upper edge of the bobbin case.

* * * * *